US005503567A

United States Patent [19]

Gow et al.

[11] Patent Number: 5,503,567

[45] Date of Patent: Apr. 2, 1996

[54] TERMINATION MODULE

[75] Inventors: Neil Gow, Stroud; Keith White, Churchdown, both of United Kingdom; Peter Becker, Berlin, Germany; Adrian Benedetto, Berlin, Germany; Reinhard Brettschneider, Berlin, Germany; Wolfgang Radelow, Berlin, Germany

[73] Assignee: Krone Aktiengesellschaft, Berlin-Zehlendorf, Germany

[21] Appl. No.: 254,149

[22] Filed: Jun. 6, 1994

[30] Foreign Application Priority Data

Jun. 29, 1993 [DE] Germany ..... 43 22 383.4
Jun. 29, 1993 [DE] Germany ..... 93 10 004 U

[51] Int. Cl.[6] ..... H01R 4/24

[52] U.S. Cl. ..... 439/411; 439/418

[58] Field of Search ..... 439/409–413, 439/417–419, 709, 712, 713, 723–725, 727, 395, 404

[56] References Cited

U.S. PATENT DOCUMENTS

| | | | |
|---|---|---|---|
| 3,129,048 | 4/1964 | Brock | 439/412 |
| 3,163,482 | 12/1964 | Hubbell et al. | 439/412 |
| 4,597,623 | 7/1986 | Krumreich | 439/411 |
| 4,917,633 | 4/1990 | Lacoste | 439/413 |
| 5,015,198 | 5/1991 | Delin | 439/411 |
| 5,199,899 | 4/1993 | Statah | 439/403 |
| 5,203,716 | 4/1993 | Martucci et al. | 439/411 |

FOREIGN PATENT DOCUMENTS

3137429C2 3/1984 Germany .

OTHER PUBLICATIONS

Connection Modules MX Brochure of Quante Aktiengesellschaft Uellendahler Str. 353m D–42109 Wuppertal 1.

*Primary Examiner*—David L. Pirlot
*Attorney, Agent, or Firm*—McGlew and Tuttle

[57] ABSTRACT

The present invention relates to a termination module comprising multiple contacts for the termination of cable wires at an insulation displacement contact and comprising a pressure piece with a screw, an intermediate piece and a base plate. The object of the invention, is to develop a termination module of the type in which cable wires having different wire diameters can be terminated in a wide range. It is achieved by a closed bifurcated contact connected as one piece over a connection plate 21 with insulation displacement contact 7 and a tapping 18, insulation displacement contact 7 being disposed inclinedly behind bifurcated contact 6.

17 Claims, 4 Drawing Sheets

TERMINATION MODULE

FIELD OF THE INVENTION

The present invention relates to a termination module which provides a termination point where incoming and outgoing wires can be electrically and physically connected. More specifically the present invention relates to a termination module having structure which can repetitively connect and disconnect to a plurality of outgoing wires having different thicknesses.

BACKGROUND OF THE INVENTION

A termination module of the type referred to hereinbefore is known in the art (brochure of Quante Aktiengesellschaft, Uellendahler Str. 353, D-42109 Wuppertal 1: "Connection Modules MX"). With the prior art termination module, termination of incoming wires and of outgoing wires is possible for a tightly limited range of wire diameters. It is particularly disadvantageous that due to the construction of the contacts disposed within the module, no larger range of wire diameters can be terminated after each other. The termination of open-air cables (dropwires) having larger wire diameters is not possible, or the termination of smaller wire diameters after having terminated larger wire diameters several times before, is not guaranteed because of the inflexible contact configuration.

A multiple contact for the termination of two incoming and two outgoing wires is known in the art from DE 31 37 429 C2. The contacts are insulation displacement contacts and consist of a blade-type resilient contact material, the blade surface being disposed inclinedly to the conductor termination direction and parallely to the respective adjacent element. The termination contacts are provided in the lower section with connection points of a U-shaped cross-section. Further, extensions are provided below the termination contacts.

It is disadvantageous, in said prior art multiple contacts, that a tightly limited range only of wire diameters can be connected to a contact configuration. It is not possible after having terminated several times a larger wire diameter, to afterwards terminate a smaller wire diameter, since the geometry does not guarantee the flexibility of the contacts required therefore.

SUMMARY AND OBJECTS OF THE INVENTION

It is therefore the object of the invention to develop a termination module of the type referred to hereinbefore, at which optionally cable wires having different wire diameters can be terminated in a wide range.

The present invention has a base plate which includes a rail latch means which has been specifically designed for repetitively connecting and disconnecting one side of the base plate with commercial profile rails without substantially damaging the base plate. An intermediate piece has a base latching means which is specifically designed for repetitively connecting and disconnecting the intermediate piece with another side of the base plate which is substantially opposite from the one side of the base plate that connects to the profile rails. Positioned in the intermediate piece is a multiple contact means for repetitively making a plurality of connections with outgoing wires having different thicknesses. The multiple contact means preferably is initially formed from a sheet of metal. A center portion of this sheet of metal is a connection plate and a closed bifurcated contact element is formed by bending a portion of the sheet substantially perpendicular to the connection plate. An inclined contact element is formed on another side of the connection plate by bending the sheet metal substantially perpendicular to the connection plate and in substantially the same direction as the closed bifurcated contact element. The closed bifurcated contact element and the incline contact element, being on substantially opposite sides of the connection piece. A tapping is formed by bending a portion of the sheet adjacent the connection plate in a direction substantially opposite to the closed bifurcated contact element and the incline contact element. The tapping extends through the intermediate piece towards the base plate and electrically connects to a base contact in the base plate. The electrical contact between the base contact and the multiple contact means is also designed for repetitively connecting and disconnecting.

A pressure piece has a screw which is repetitively connectable and disconnectable with the side of the intermediate piece which is substantially opposite from the base plate. The pressure piece defines first and second contact chambers for the wire which is to be contacted by the multiple contact means. The first chamber receives the closed bifurcated contact element and the second chamber receives the inclined contact element when the pressure piece is connected to the intermediate piece. The base contacts also have insulation displacement contacts for connecting to incoming wires. The base contacts and the intermediate piece also have structure for electrically connecting and housing function elements such as surge arresters and filters.

The intermediate piece is easily disconnected from the base piece, for rewiring and testing of the incoming and outgoing wires. The multiple contact means can connect two wires having different diameters because of the different contact elements. The chambers in the pressure piece can also be filled with a substance that surrounds the wires and contact elements when the pressure preset piece is connected to the intermediate piece, in order to protect the wires and contact elements from the surrounding environment.

The termination module permits, without the use of special tools, to connect plastic-insulated wires and open-air cables with each other by means of an insulation displacement contact arrangement, and to separate them by releasing a latch device, and to test them separately. The contacts on the base plate permit the arrangement of, e.g., voltage surge arresters. The contact chambers are protected against corrosive atmospheres and humidity. The termination module can be snapped in a simple manner onto commercial profile rails. When mounting several termination modules as a block adjacent to each other, individual termination modules can simply be removed from the profile rail and re-inserted, without the adjacent termination modules being affected in their operation. The contact arrangements guarantee the possibility of the termination of a large range of wire diameters.

By means of the present contact configuration, wires having smaller diameters as well as open-air cables (dropwires) having larger diameters can be contacted. Several times successively can be wired larger diameters and then smaller diameters.

Further advantageous embodiments of the invention are defined in the sub-claims.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
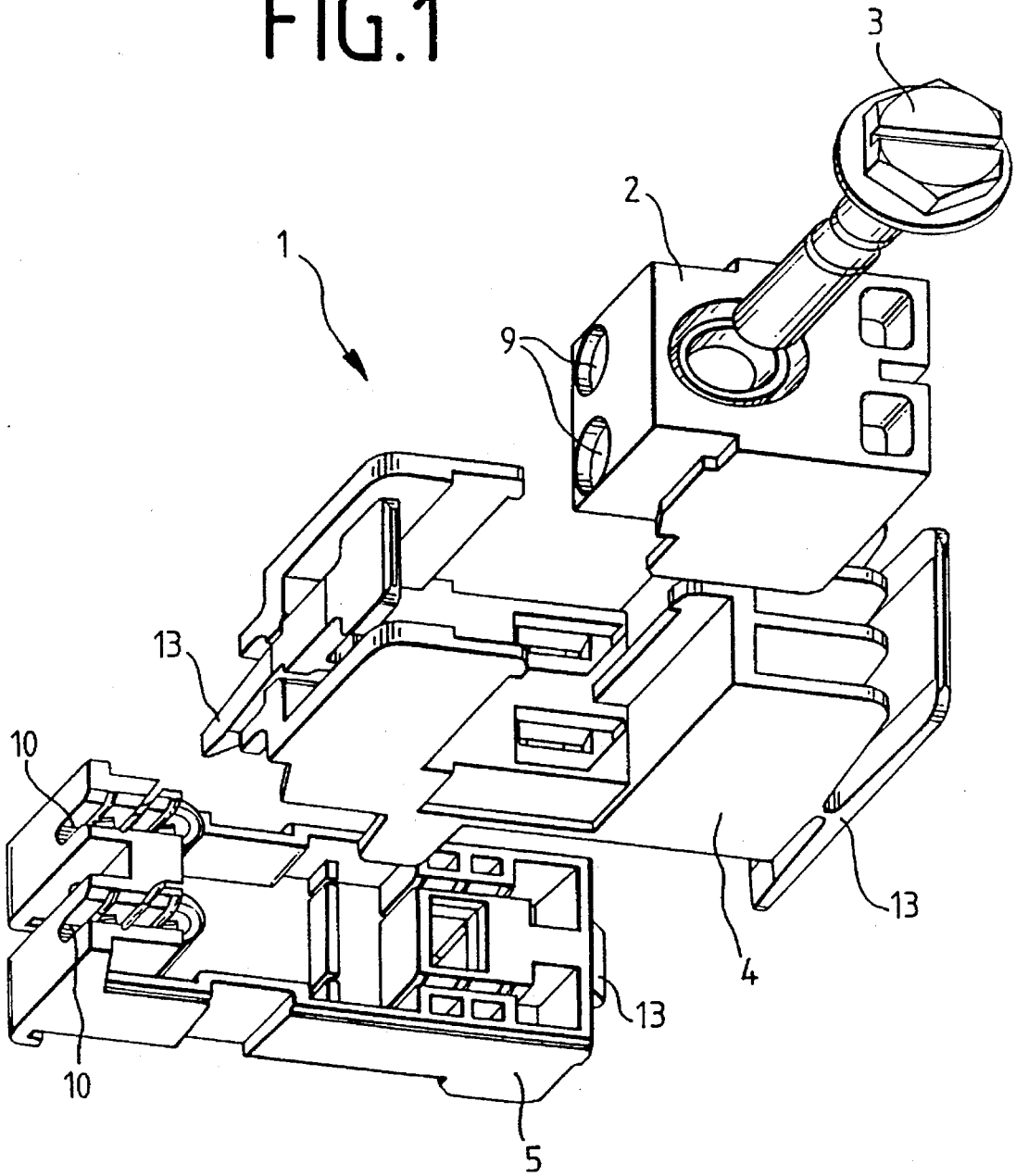
FIG. 1 an exploded view of the termination module viewed from above.

Termination module 1 comprises, according to FIG. 1, a pressure piece 2 with a plastic screw 3, an intermediate piece 4 and a base plate 5. Base plate 5 and intermediate piece 4 are loosenably connected with each other by a base latch device or means 13. Pressure piece 2 with plastic screw 3 is integrated in intermediate piece 4. After assembly, pressure piece 2 and intermediate piece 4 are nearly unloosenably connected with one another and are displaceable relative to one another in a tightly limited range only. Base plate 5 is provided with a rail latch device 14 (FIG. 2) or means by which termination module 1 is snapped onto a not shown commercial profile rail.

Figure 2:
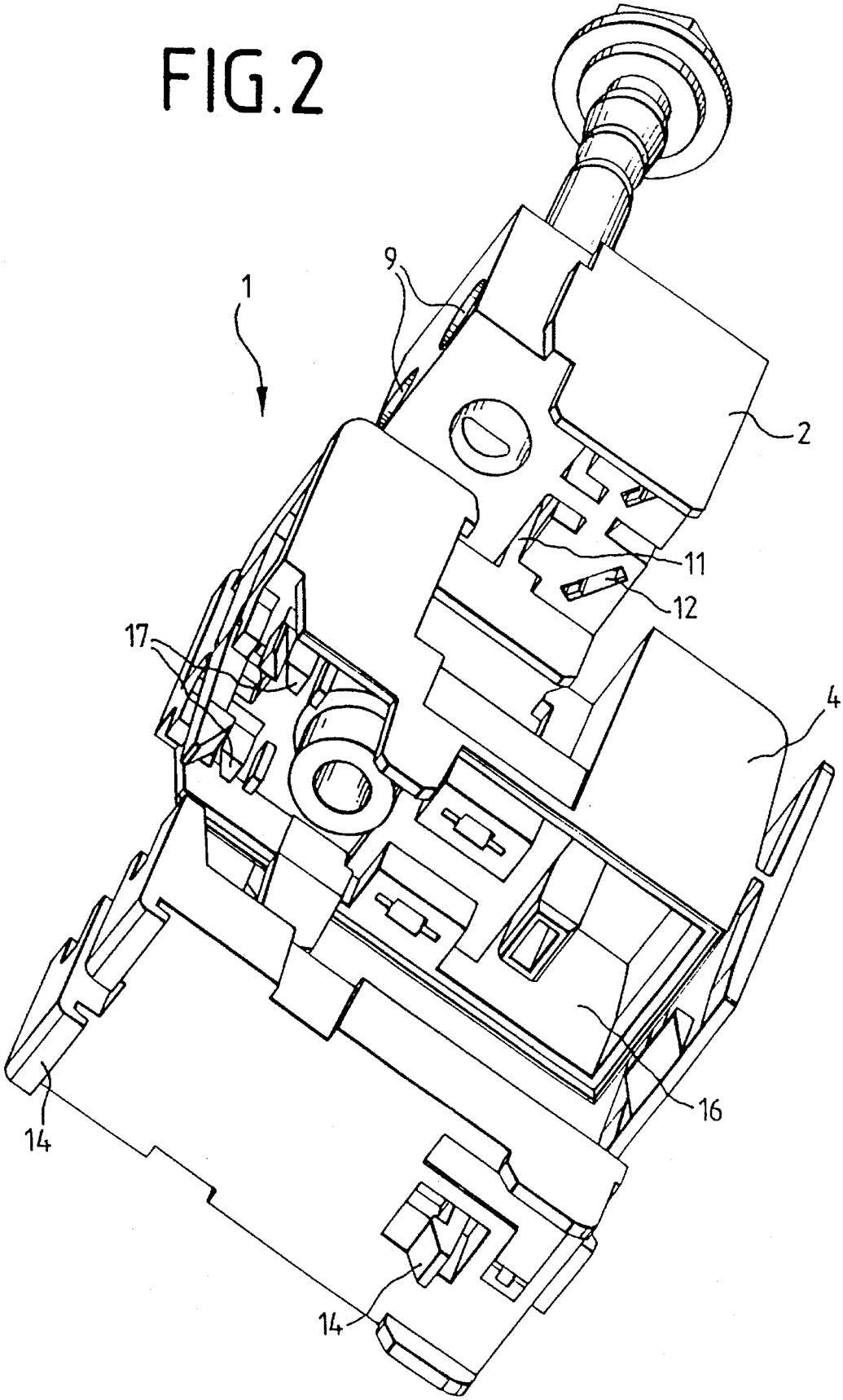
FIG. 2 the exploded view of the termination module viewed from below.

As is shown in FIG. 2, the not shown outgoing wires are fed in two separate contact chambers 11, 12 through openings 9 to pressure piece 2. By means of plastic screw 3 and pressure piece 2, the outgoing wires are rectilinearly moved downwards into intermediate piece 4. Contact elements 6, 7 of double contact 20 (FIGS. 3, 4) fixedly disposed in intermediate piece 4 penetrate the insulation of the outgoing wires and gas-tightly contact the respective wires.

Figure 4:
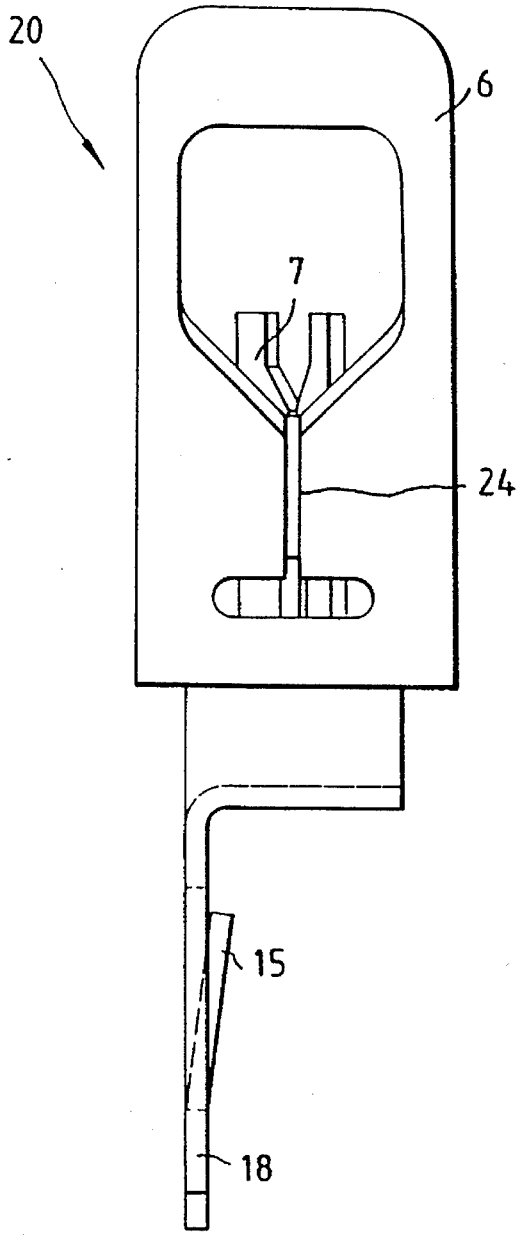
FIG. 4 a front view of the multiple contact.
Figure 3:
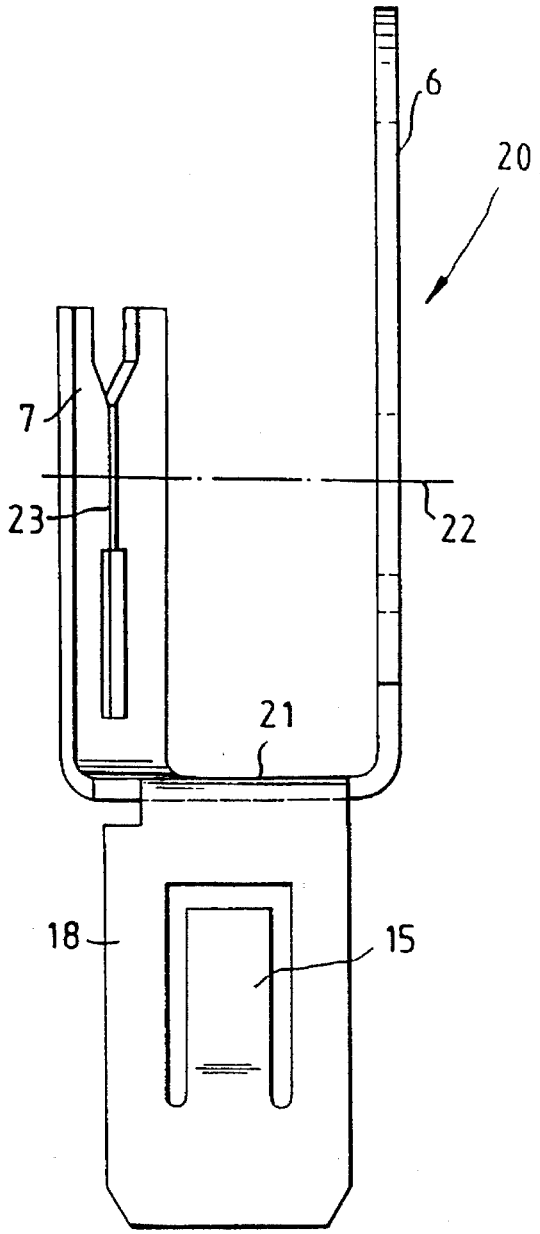
FIG. 3 a side view of a multiple contact for the outgoing wires to be integrated in thee termination module.

Contact elements 6, 7 are, according to the representation in FIGS. 3 and 4, adapted as one piece so to form a double contact 20. Contact element 6 is a closed bifurcated contact being disposed in a 90° position to the wire axis 22. Contact element 7 is formed of an insulation displacement contact disposed inclinedly by 30°. At the connection point between the two contact elements 6, 7 a tapping 18 having a bent-away latch lug 15 is disposed.

Figure 5:
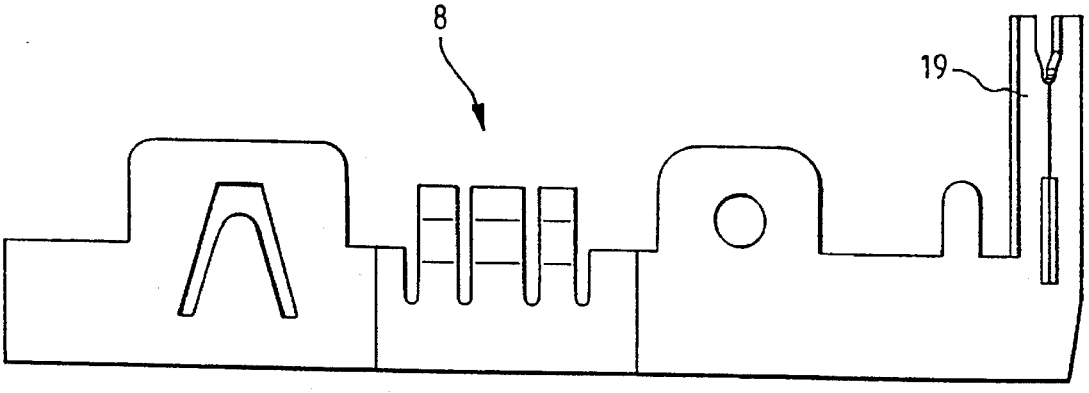
FIG. 5 a side view of a contact for the incoming wires to be integrated in the termination module.

Base contacts 8 in the representation according to FIG. 5 are disposed for the incoming wires in the base plate 5. The incoming wires are fed through openings 10 (FIG. 1) to the base contacts 8. Contacts 8 are configured as insulation displacement contacts 19. A specially shaped projection 17 at intermediate piece 4 (FIG. 2) serves as a wiring tool for inserting the incoming wires into insulation displacement contact 19. Contacts 8 in base plate 5 engage in fork-type manner around tapping 18 of double contact 20 in intermediate piece 4 (FIG. 3), so that an electrical connection is established.

By the special configuration of contact elements 6, 7 according to FIGS. 3 and 4 as a double contact 20, wires having diameters of 0.4 mm to 0.8 mm as well as dropwires having diameters of 0.7 mm to 1.3 mm can be gas-tightly contacted. Several times successively, dropwires up to a maximum of 1.3 mm wire diameters and subsequently after replacement of such wires, thinner wires down to a minimum of 0.4 mm wire diameters can be wired. The wires having the larger diameters are contacted by the bifurcated contact of contact element 6. The wires having the smaller diameters are passed through the bifurcated contact of contact element 6 and wired to the insulation displacement contact of contact element 7. The bifurcated contact acts in this case as a clamping rib and laterally secures the position of the wire.

Intermediate piece 4 can be delatched from base plate 5 (FIGS. 1, 2) such that the pieces with the respective contacts 20 and 8 are departed from each other and thus a separation of electrical contacts 8 of the incoming wires from contact elements 6, 7 of the outgoing wires can be performed. In the separated condition, both sides of the connection can independently be checked.

Onto contacts 8 in base plate 5 can be placed a separate function element in chamber 16 (FIG. 2), for instance a voltage surge arrester for protecting the termination module 1 against voltage surges.

Termination module 1 can be latched onto commercial profile rails by means of the latch device 14. When mounting several termination modules 1 as a block besides each other, individual termination modules 1 can be removed from the profile rail by means of a screwdriver or the like and can be re-inserted, without affecting the adjacent termination modules 1 in their operation.

Pressure piece 2 is made of a transparent plastic material for optically checking a proper contact.

Contact chambers 11, 12 in pressure piece 2 and the contact chambers in base plate 5 are filled with grease as an additional protection against corrosive atmospheres and humidity.

Double contact 20 is preferably made of silver-plated special brass.

While specific embodiments of the invention have been shown and described in detail to illustrate the application of the principles of the invention, it will be understood that the invention may be embodied otherwise without departing from such principles.

LIST OF REFERENCES

1 termination module
2 pressure piece
3 screw
4 intermediate piece
5 base plate
6 contact element (bifurcated contact)
7 contact element
8 contact
9 opening
10 opening
11 contact chamber
12 contact chamber
13 latch device
14 latch device
15 latch lug
16 chamber
17 projection
18 tapping
19 insulation displacement contact

20 double contact

21 connection plate

22 wire axis

23 contact slot

24 contact slot

We claim:

1. A termination module comprising:

a base plate;

an intermediate piece connectable with said base plate;

a pressure piece and a screw connectable with said intermediate piece;

multiple contact means for repetitively making contact with an outgoing wire having a plurality of possible different thicknesses, said multiple contact means being positioned in said intermediate piece, said multiple contact means including a connection plate, one side of said connection plate having a closed bifurcated contact element, another side of said connection plate having an inclined contact element, said inclined contact element being inclined with respect to said closed bifurcated contact element and being spaced from said closed bifurcated contact element along an axis of a wire contacted by said multiple contact means, still another side of said connection plate having a tapping, said connection plate, said closed bifurcated contact element, said inclined contact element and said tapping all being formed as a single piece.

2. A termination module in accordance with claim 1, wherein:

said closed bifurcated contact element is positioned substantially perpendicular to the axis of the wire to be contacted by said multiple contact means, said inclined contact element is positioned at a substantially 30 degree angle to the axis of the wire, and said tapping is positioned substantially perpendicular to said connection plate.

3. A termination module in accordance with claim 1, wherein:

said closed bifurcated contact element and said inclined contact element each define contact slots, said contact slots being positioned substantially in line and along the axis of the wire to be contacted by said multiple contact means.

4. A termination module in accordance with claim 1, wherein: said tapping includes a latch lug.

5. A termination module in accordance with claim 1, wherein:

said base plate includes rail latch means designed for repetitively connecting and disconnecting said base plate from commercial profile rails.

6. A termination module in accordance with claim 1, wherein:

said closed bifurcated contact element includes means for electrically connecting with a wire having a diameter between 0.7 to 1.3 millimeters, said inclined contact element includes means for electrically connecting with a wire having a diameter between 0.4 to 0.8 millimeters.

7. A termination module in accordance with claim 1, wherein:

said closed bifurcated contact element has means connectable to a first set of said plurality of possible thicknesses of the outgoing wire;

said inclined contact element has means connectable to a second set of said plurality of possible thicknesses of the outgoing wire;

said first set of possible different thicknesses having thicknesses greater than thicknesses of said second set of possible thicknesses.

8. A termination module in accordance with claim 1, wherein:

said pressure piece defines first and second contact chambers for the wire to be contacted by said multiple contact means;

said intermediate piece and said base plate include base latching means designed for connecting and disconnecting said intermediate piece and said base plate repetitively;

said base plate including base contacts, said base contacts including insulation displacement contacts for incoming wires.

9. A termination module in accordance with claim 8, wherein:

said multiple contact means and said base contacts include means designed for repetitively connecting and disconnecting said multiple contact means and said base contacts both electrically and spatially from each other.

10. A termination module in accordance with claim 8, wherein:

said base contacts include means for connecting to functional elements.

11. A termination module comprising:

a base plate including rail latch means designed for repetitively connecting and disconnecting one side of said base plate with commercial profile rails;

an intermediate piece including base latching means designed for repetitively connecting and disconnecting said intermediate piece with another side of said base plate substantially opposite from said one side;

multiple contact means designed for repetitively making a plurality of contacts with a plurality of outgoing wires having different thicknesses, said multiple contact means being positioned in said intermediate piece, said multiple contact means including a connection plate, one side of said connection plate having a closed bifurcated contact element, another side of said connection plate having an inclined contact element, said inclined contact element being inclined with respect to said closed bifurcated contact element and being spaced from said closed bifurcated contact element along an axis of a wire contacted by said multiple contact means, still another side of said connection plate having a tapping, said tapping extending though said intermediate piece toward said base plate;

a pressure piece with a screw being connectable with a side of said intermediate piece substantially opposite from said base plate, said pressure piece defines first and second contact chambers for the wire to be contacted by said multiple contact means, said first chamber also receiving said closed bifurcated contact element when said pressure piece is connected to said intermediate piece, said second chamber also receiving said inclined contact element when said pressure piece is connected to said intermediate piece;

base contacts positioned with said base plate, said base contacts including insulation displacement contacts for incoming wires, said base contacts include means for connecting to functional elements, and said intermediate piece defines a chamber for receiving the functional elements.

12. A termination module in accordance with claim 11, wherein:

the functional elements includes a surge arrester.

13. A termination module comprising:

a base plate;

an intermediate piece connectable with said base plate;

a pressure piece connectable with said intermediate piece;

multiple contact means for repetitively making contact with an outgoing wire having a plurality of possible different thicknesses, said multiple contact means being positioned in said intermediate piece, said multiple contact means including a connection plate, one side of said connection plate having a first contact element, said first contact element having means connectable to a first set of said plurality of possible thicknesses of the outgoing wire, another side of said connection plate having a second contact element, said second contact element being spaced from said first contact element along an axis of the outgoing wire contacted by said multiple contact means, said second contact element having means connectable to a second set of said plurality of possible thicknesses of the outgoing wire, said first set of possible different thicknesses having thicknesses greater than thicknesses of said second set of possible thicknesses, still another side of said connection plate having a tapping, said connection plate, said first contact element, said second contact element and said tapping all being formed as a single piece.

14. A termination module in accordance with claim 13, wherein:

said first contact element is a closed bifurcated contact element;

said second contact element is a inclined contact element being inclined with respect to said closed bifurcated contact element.

15. A termination module in accordance with claim 13, wherein:

said first set of plurality of possible different thicknesses of the outgoing wire includes drop wire having thicknesses between 0.7 to 1.3 millimeters;

said second set of plurality of possible different thicknesses of the outgoing wire includes thicknesses between 0.7 to 1.3 millimeters.

16. A termination module in accordance with claim 13, wherein:

said pressure piece defines first and second contact chambers for causing the wire to be contacted by said multiple contact means;

said intermediate piece and said base plate include base latching means designed for connecting and disconnecting said intermediate piece and said base plate repetitively;

said base plate including base contacts, said base contacts including insulation displacement contacts for incoming wires.

17. A termination module in accordance with claim 13, wherein:

said base plate includes rail latch means designed for repetitively connecting and disconnecting said base plate frown commercial profile rails.

* * * * *